US005882250A

United States Patent [19]

Foster

[11] Patent Number: 5,882,250

[45] Date of Patent: Mar. 16, 1999

[54] VALVE REFACING TOOL

[76] Inventor: John R. Foster, P.O. Box 147, Lincolnville, Me. 04849-0147

[21] Appl. No.: 868,839

[22] Filed: Jun. 9, 1997

[51] Int. Cl.[6] ..... B24B 19/00

[52] U.S. Cl. ..... 451/430; 451/431; 451/540

[58] Field of Search ..... 451/430, 431, 451/36, 523, 524, 542, 557, 49, 51, 252, 558, 217, 317, 319, 323, 540, 548, 550, 439, 440, 115, 415; 408/72 R, 79, 80, 82, 83.5

[56] References Cited

U.S. PATENT DOCUMENTS

| | | | |
|---|---|---|---|
| 2,022,821 | 12/1935 | Ostman | 451/430 |
| 2,133,612 | 10/1938 | Gallivan | 451/430 |
| 3,183,635 | 5/1965 | Spirounis | 451/430 |
| 3,184,894 | 5/1965 | Bayes | 451/430 |
| 4,467,566 | 8/1984 | Ondrus, Jr. et al. | 451/430 |
| 4,581,854 | 4/1986 | Collopy | 451/430 |
| 4,637,762 | 1/1987 | Acker | 451/430 |
| 5,749,774 | 5/1998 | Foster | 451/430 |

FOREIGN PATENT DOCUMENTS

| | | | |
|---|---|---|---|
| 1413750 | 11/1975 | United Kingdom | 451/430 |

*Primary Examiner*—David A. Scherbel
*Assistant Examiner*—Derris H. Banks

[57] ABSTRACT

A valve refacing tool comprising a hollow cylindrical column. The column has an upper end and a lower end and has a central bore throughout its entire length. The column has exterior threads at its upper end and an outwardly flared cylindrical support at its lower end. A crown is provided and has a central vertical bore with internal threads removably received by the threads at the upper end of the column. The crown has a lower surface with a radial interior edge adapted to be supported on the upper end of the column. The crown has a plurality of radially extending fins each with an enlarged height at its radially exterior edge and an upper surface at an angle with respect to the vertical. Each upper surface has a dove tail recess. A cylindrical bushing sleeve is positioned within the bore of the column. The bushing sleeve has an upper end located at an intermediate extent of the column and a lower end located beneath the lower end of the column. The bushing sleeve has spaced bushings of a bearing material adapted to receive and rotatably support the cylindrical stem of a valve to be ground. An aperture is formed in an intermediate extent of the column with a securement component positioned in the aperture to contact and position the sleeve with respect to the column. A plurality of grind pads are provided.

8 Claims, 9 Drawing Sheets

FIG 11
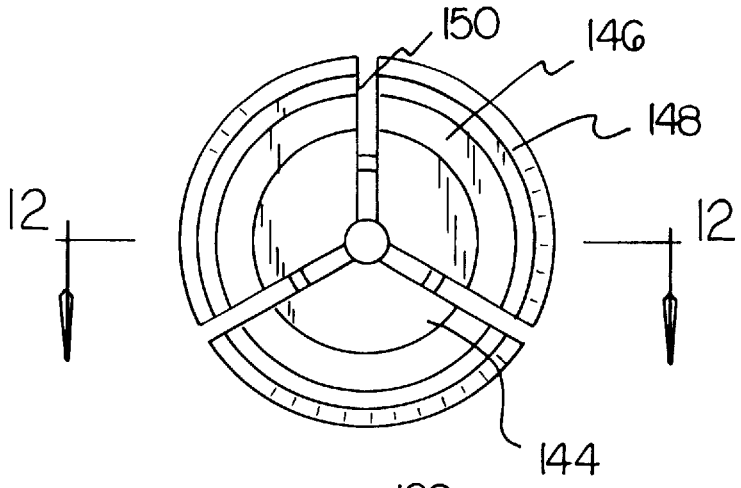
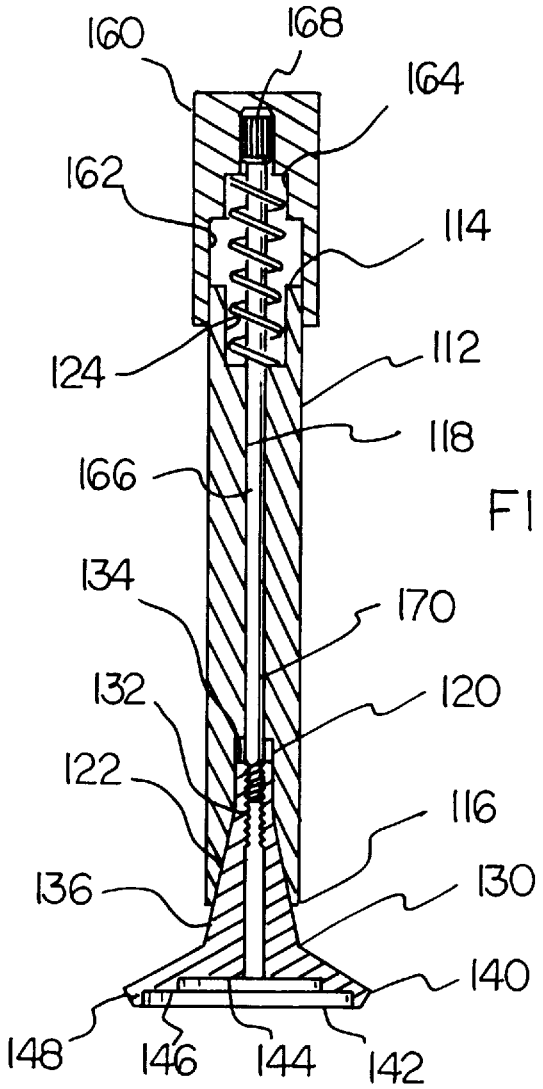
FIG 12

FIG 15
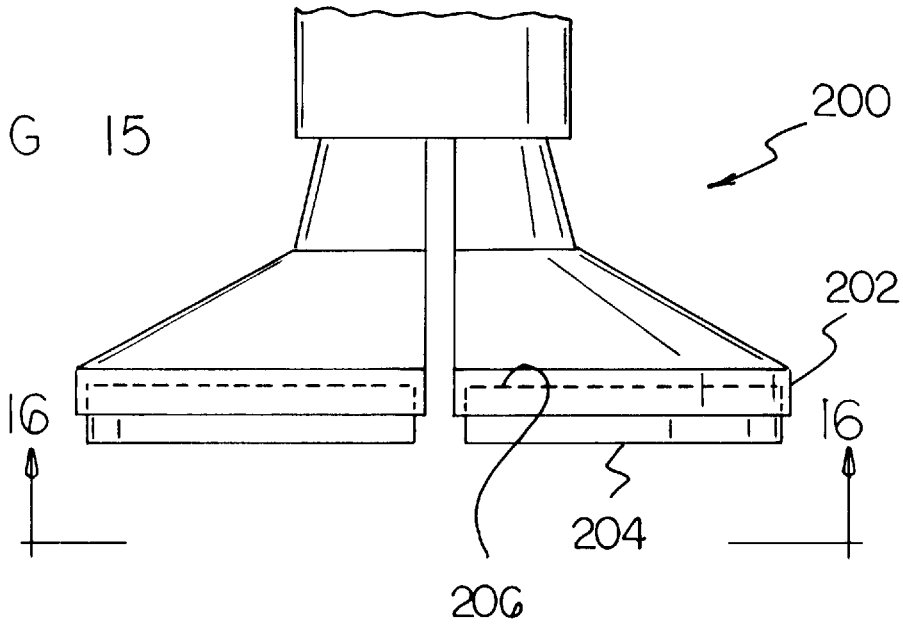
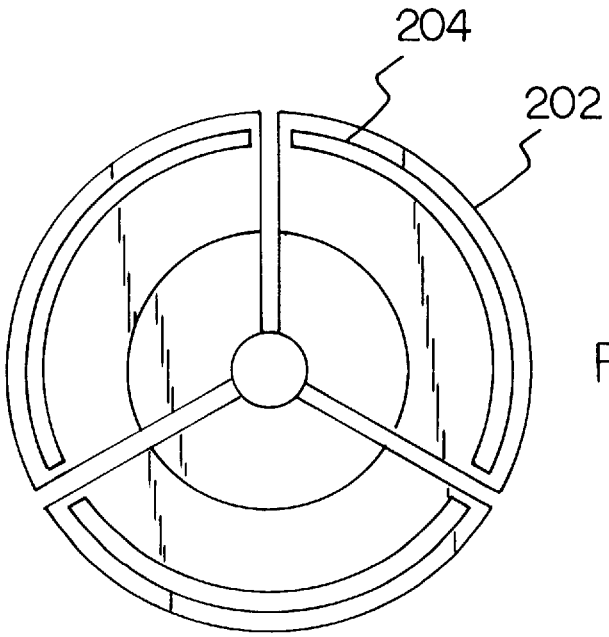
FIG 16

VALVE REFACING TOOL

BACKGROUND OF THE INVENTION

1. Field of the Invention

The present invention relates to a valve refacing tool and, more particularly, pertains to restoring concentricity between a valve face and its center line through a hand-held device.

2. Description of the Prior Art

The use of devices for grinding valves of various designs and configurations are known in the prior art. More specifically, devices for grinding valves of various designs and configurations heretofore devised and utilized for the purpose of restoring concentricity to valves through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 5,199,222 to Leroux et al., discloses a device for grinding the head of a valve, especially of an internal-combustion engine.

U.S. Pat. No. 5,070,653 to Amundsen discloses a centerless valve regrinder.

U.S. Pat. No. 4,428,160 to Willemsen et al., discloses centerless valve grinding.

U.S. Pat. No. 4,270,427 to Colberg et al., discloses a bevel angle setting means for a power tool apparatus.

U.S. Pat. No. 4,930,261 to Tiegs et al., discloses a valve resurfacing apparatus and method for making the same.

Lastly, U.S. Pat. No. 5,159,786 to Amundsen discloses a method for regrinding a work valve.

In this respect, the valve refacing tool according to the present invention substantially departs from the conventional concepts and designs of the prior art, and in so doing provides an apparatus primarily developed for the purpose of restoring concentricity between a valve face and its center line through a hand-held device.

Therefore, it can be appreciated that there exists a continuing need for new and improved valve refacing tool which can be used for restoring concentricity between a valve face and its center line through a hand-held device. In this regard, the present invention substantially fulfills this need.

SUMMARY OF THE INVENTION

In view of the foregoing disadvantages inherent in the known types of devices for grinding valves now present in the prior art, the present invention provides an improved valve refacing tool. As such, the general purpose of the present invention, which will be described subsequently in greater detail, is to provide a new and improved valve refacing tool which has all the advantages of the prior art and none of the disadvantages.

To attain this, the present invention essentially comprises a new and improved valve refacing tool for restoring concentricity between the valve center line and the valve face, comprising, in combination, a hollow cylindrical die cast aluminum column. The column has an upper end and a lower end and has a central bore throughout its entire length. The column has exterior threads at its upper end and an outwardly flared cylindrical support at its lower end. A crown is provided and has a central vertical bore with internal threads removably received by the threads at the upper end of the column. The crown has a lower surface with a radial interior edge adapted to be supported on the upper end of the column. The crown has four radially extending fins. Each fin has an enlarged height at its radially exterior edge and an upper surface at an angle of 45 degrees with respect to the vertical. Each upper surface has a dove tail recess. A cylindrical bushing sleeve is positioned within the bore of the column. The bushing sleeve has an upper end located at an intermediate extent of the column and a lower end located beneath the lower end of the column. The bushing sleeve has spaced bushings of a bearing material adapted to receive and rotatably support the cylindrical stem of a valve to be ground. The bearing material is selected from the class of bearing materials including NYLON and BRONZE. An aperture is formed in an intermediate extent of the column with a securement component positioned in the aperture to contact and position the sleeve with respect to the column. A plurality of grind pads are provided. Each grind pad has an upper surface and a lower dovetail projection positioned in an associated dove-tail slot of the crown with an associated locking bolt to secure the pads at a preset position on the upper surface of the crown. The grind pads each have on its upper surface an abrasive hard aluminum oxide flex file with an adhesive backing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved valve refacing tool which has all the advantages of the prior art devices for grinding valves and none of the disadvantages.

It is another object of the present invention to provide a new and improved valve refacing tool which may be easily and efficiently manufactured and marketed.

It is a further object of the present invention to provide a new and improved valve refacing tool which is of a durable and reliable construction.

An even further object of the present invention is to provide a new and improved valve refacing tool which is susceptible of a low cost of manufacture with regard to both materials and labor, and which accordingly is then susceptible of low prices of sale to the consuming public, thereby making such valve refacing tool economically available to the buying public.

Still yet another object of the present invention is to provide a new and improved valve refacing tool which provides in the apparatuses and methods of the prior art some of the advantages thereof, while simultaneously overcoming some of the disadvantages normally associated therewith.

Still another object of the present invention is to restore concentricity between a valve face and its center line through a hand-held device.

Lastly, it is an object of the present invention to provide a new and improved valve refacing tool comprising a hollow cylindrical column. The column has an upper end and a lower end and has a central bore throughout its entire length. The column has exterior threads at its upper end and an outwardly flared cylindrical support at its lower end. A crown is provided and has a central vertical bore with internal threads removably received by the threads at the upper end of the column. The crown has a lower surface with a radial interior edge adapted to be supported on the upper end of the column. The crown has a plurality of radially extending fins each with an enlarged height at its radially exterior edge and an upper surface at an angle with respect to the vertical. Each upper surface has a dove tail recess. A cylindrical bushing sleeve is positioned within the bore of the column. The bushing sleeve has an upper end located at an intermediate extent of the column and a lower end located beneath the lower end of the column. The bushing sleeve has spaced bushings of a bearing material adapted to receive and rotatably support the cylindrical stem of a valve to be ground. An aperture is formed in an intermediate extent of the column with a securement component positioned in the aperture to contact and position the sleeve with respect to the column. A plurality of grind pads are provided.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 11 is a bottom view of the alternate embodiment of the present invention.

FIG. 12 is a cross-sectional view of the alternate embodiment of the present invention taken along line 4—4 shown in FIG. 3.

FIG. 15 is a close-up view of a lower extent of a second alternate embodiment of the present invention.

FIG. 16 is a bottom view of the second alternate embodiment of the present invention.

Similar reference characters refer to similar parts throughout the several views of the drawings.

DESCRIPTION OF THE PREFERRED EMBODIMENT

Figure 1:
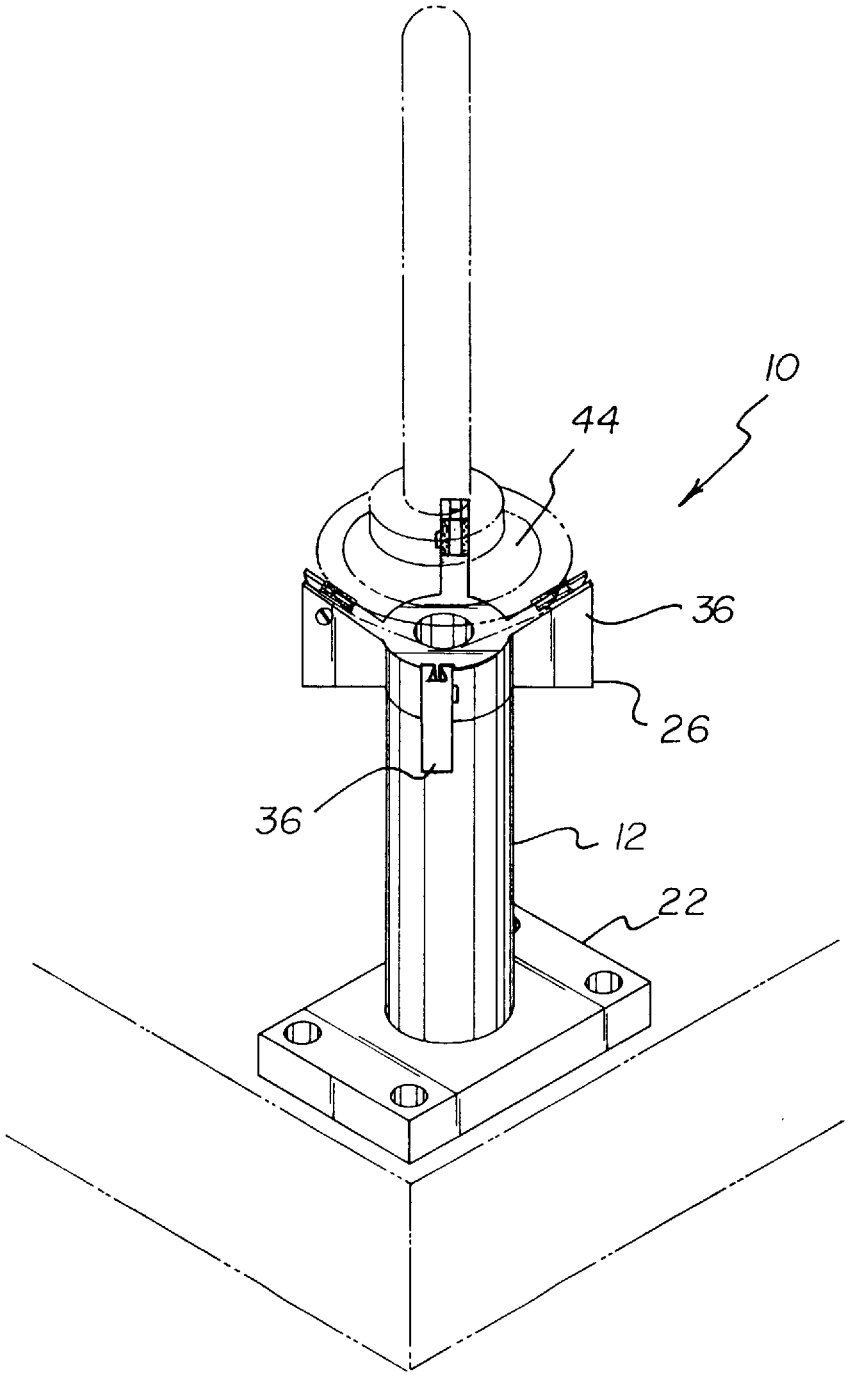
FIG. 1 is a perspective illustration of the preferred embodiment of the valve refacing tool constructed in accordance with the principles of the present invention.

With reference now to the drawings, and in particular to FIG. 1 thereof, a new and improved valve refacing tool embodying the principles and concepts of the present invention and generally designated by the reference numeral 10 will be described.

The present invention, the new and improved valve refacing tool, is comprised of a plurality of components. Such components in their broadest context include a hollow cylindrical column, a crown, a cylindrical bushing sleeve, an aperture and a plurality of grind pads. Such components are individually configured and correlated with respect to each other so as to attain the desired objective.

A central component of the system 10 of the present invention is a column 12. The column is a hollow cylindrical die cast aluminum piece. It has an upper end 14 and a lower end 16. It also has a central vertical bore 18 throughout its entire length from the upper end to the lower end. In addition, the column has exterior threads 20 at its upper end. It also has an outwardly flared cylindrical support 22 at its lower end, preferably for being coupled with respect to a recipient support surface.

The next component of the system 10 of the present invention is a crown 26. The crown has a central vertical bore 28 concentric and coextensive with the bore of the column. Such bore of the crown has internal threads 30. Such threads are for removable receipt by the threads at the upper end of the column. The crown has a lower surface 32 with a radially interior edge 34. Such edge is adapted to be supported on the upper of the column. Note FIG. 4. The crown is also formed to have a plurality, preferably four, radially extending fins 36. Each fin has an enlarged height at its radially exterior edge 38. Each fin also has an upper surface 40 at an angle with respect to the vertical. Such angle is preferably 45 degrees from the vertical but may be 30 degrees or 60 degrees or any other appropriate angle as a function of the angle of the face 42 of the valve 44 to be ground to concentricity. In addition, each upper surface also has a dove-tail recess 46.

Another component of the system 10 is a cylindrical bushing sleeve 50. Such sleeve is concentric with and positioned within the bore of the column. The bushing sleeve has an upper end 52 located at an intermediate extent of the column. The bushing sleeve also has a lower end 54 located beneath the lower end of the column for being grasped by a user during operation and use. Note FIG. 4.

The bushing sleeve has an exterior surface 58 in contact with the interior surface of the bore of column. It also has an interior cylindrical surface 60 supporting a plurality, preferably two, spaced bushings 62. Such bushings are of a bearing material adapted to receive and rotatably support the cylindrical stem 64 of the valve to be ground. The bearing material is preferably selected from the class of bearing materials including NYLON and BRONZE. The interior surface of the bushing is adapted to contact the exterior surface of the valve stem.

Figure 2:
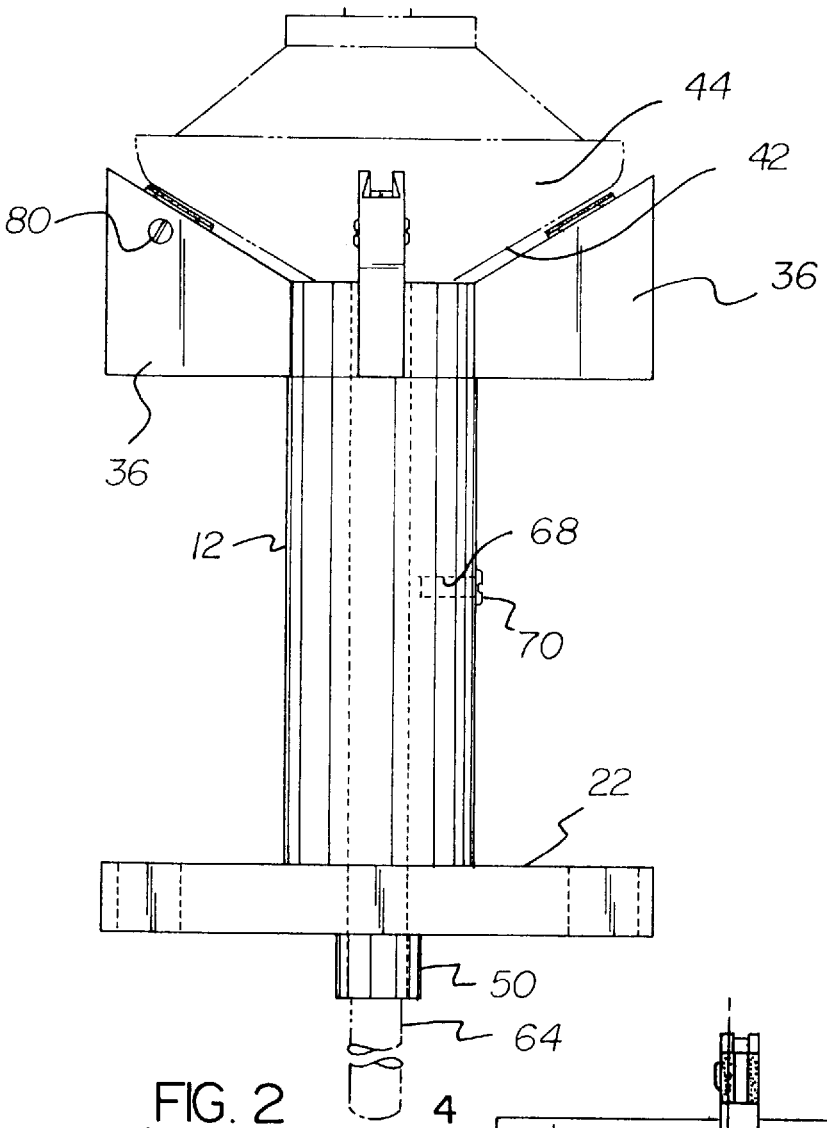
FIG. 2 is a side elevational view of the device shown in FIG. 1.
Figure 4:
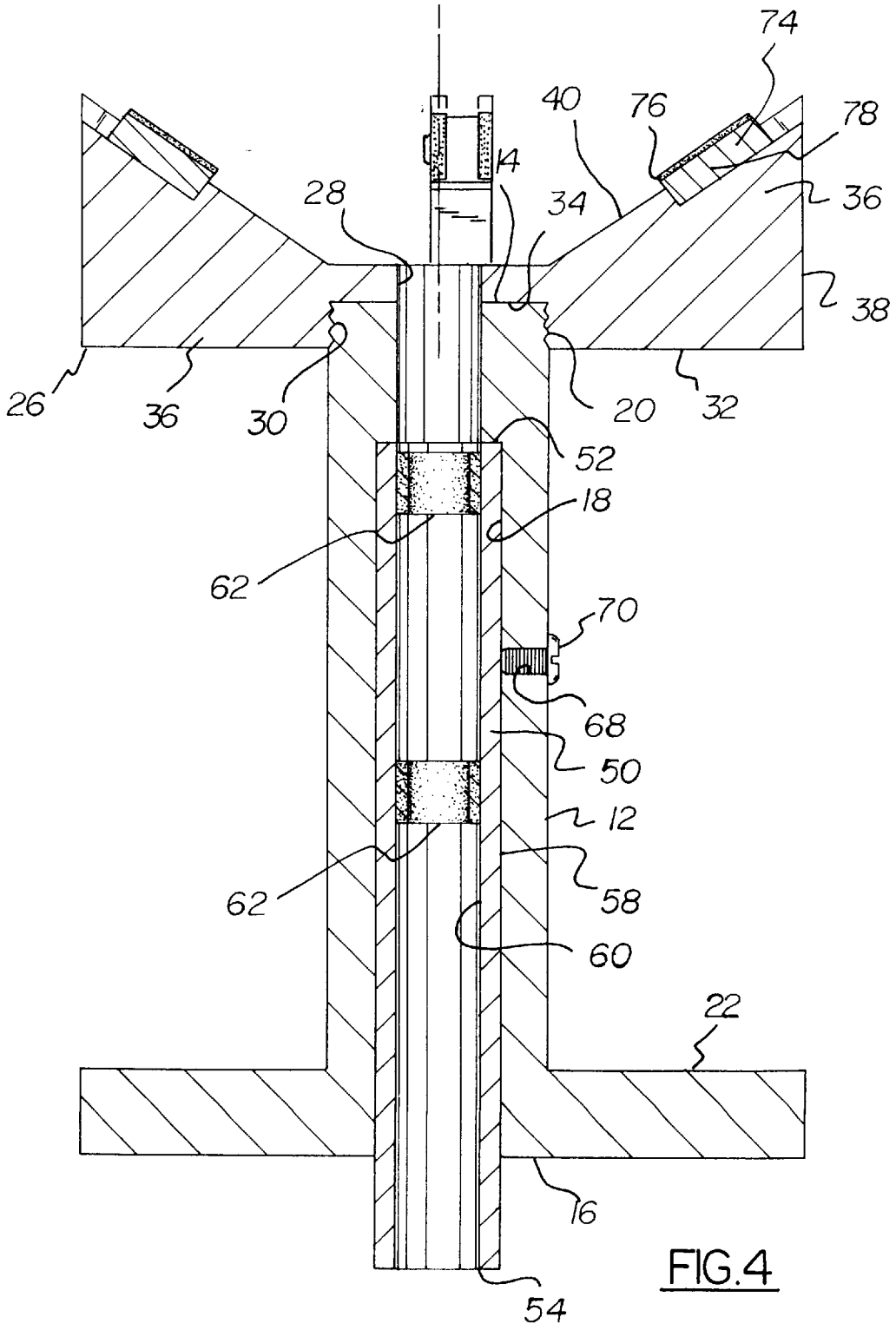
FIG. 4 is a cross sectional view taken along line 4—4 of FIG. 3.

Next provided is an aperture 68. Such aperture is formed at an intermediate extent of the column. In association therewith, a securement component 70 is positioned within the aperture to contact and position and hold the sleeve with respect to the column. As shown in FIGS. 2 and 4, the aperture is a threaded aperture and the securement component is a bolt. The bolt has an exterior end with a slot for adjustment by a user. The bolt has an interior end with a bearing surface to contact the exterior surface of the bushing sleeve. It should be understood, that various other types of securement relationships could be utilized such as aligned recesses or apertures in the bushing sleeve to make a more secure coupling between the securement component and the busing sleeve. In the alternative, the securement component could be a spring-biased ball received within one of a plurality of aligned recesses in the bushing sleeve.

Lastly provided is a plurality of grind pads 74. Each grind pad has an upper surface 76 and a lower dove-tail projection.

Figure 3:
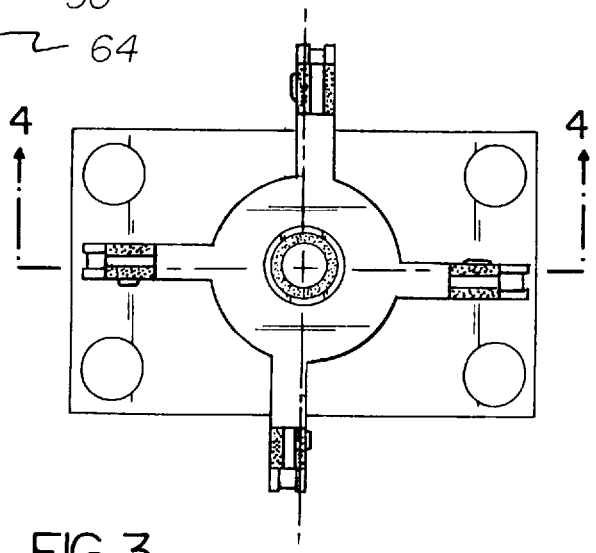
FIG. 3 is a top plan view of the device shown in FIGS. 1 and 2.
Figure 5:
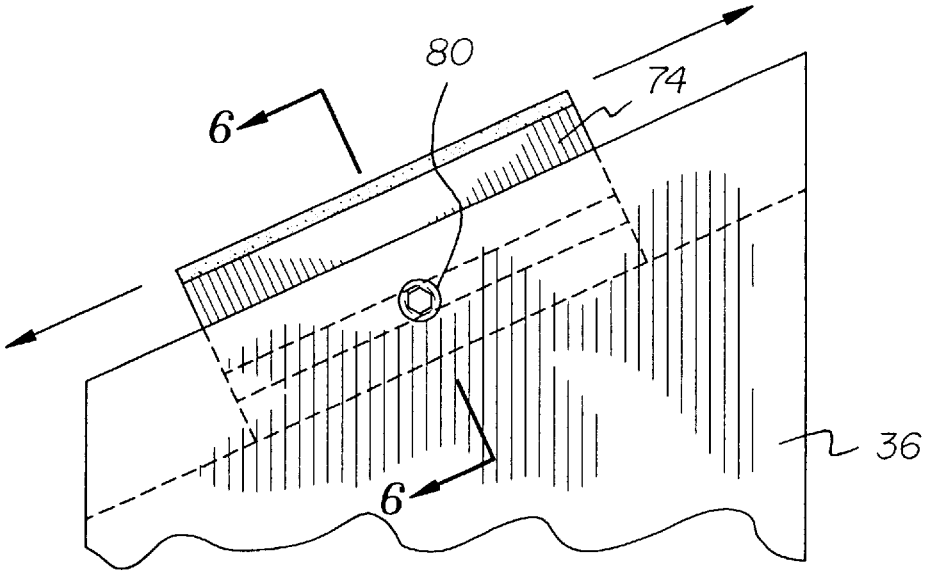
FIG. 5 is an enlarged side elevational view of one of the pads and its support.
Figure 6:
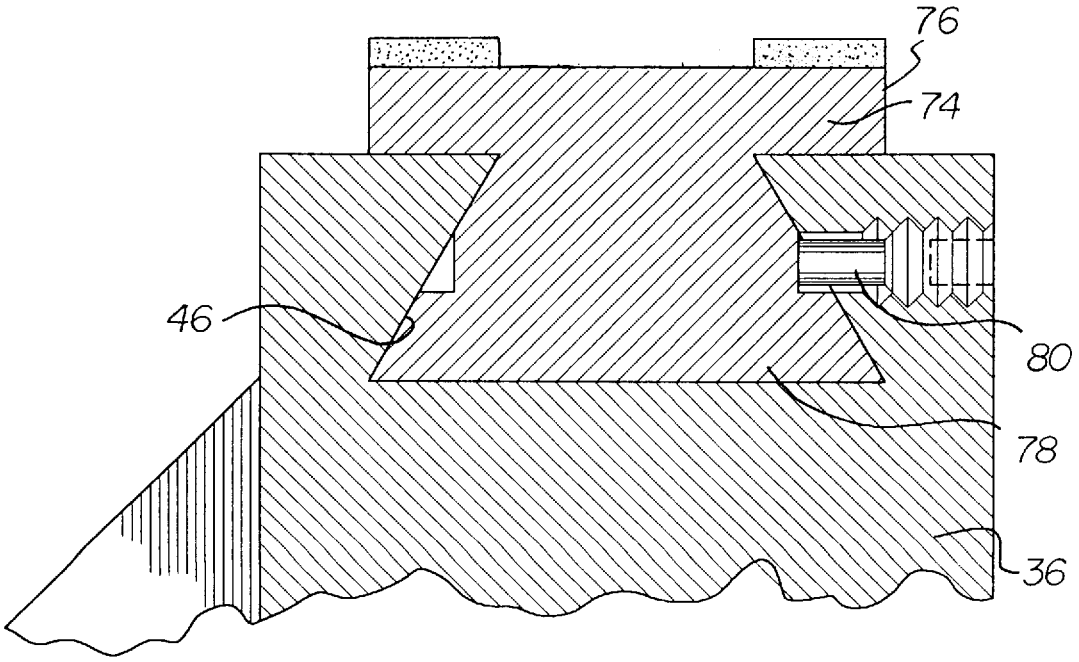
FIG. 6 is a cross sectional view taken along line 6—6 of FIG. 5.

The dove-tail projection is slidably positioned in an associated dove-tail slot of the crown. Each grind pad has an associated locking bolt 80. Such locking bolt extends through a threaded aperture in its associated fin. The locking bolt functions secure the pad in a preset position on the upper surface of the crown. Note FIGS. 5 and 6. The grind pads each have on its upper surface an abrasive hard aluminum oxide flex-file with an adhesive backing for securing such abrasive material to the grind pad, preferably at spaced lateral locations on the upper surface thereof. As shown in FIG. 3, the grinding pads are off center to allow the pads to be inverted or, in other words, turned around 180 degrees to allow the use of both sides of the pads to extend the life and usefulness thereof.

Figure 7:
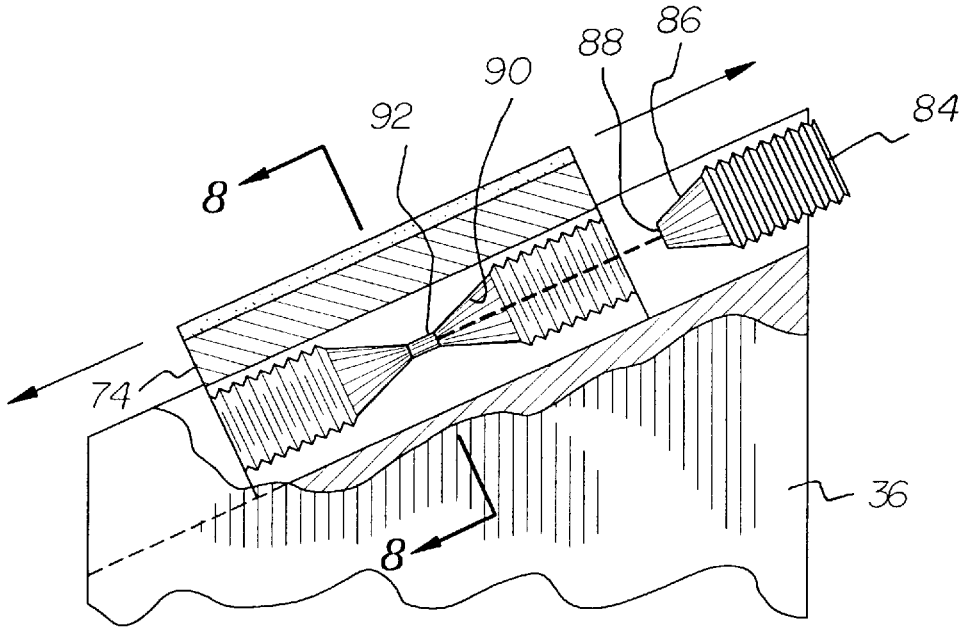
FIG. 7 is a view similar to FIG. 5 but showing an alternate embodiment of the invention.
Figure 8:
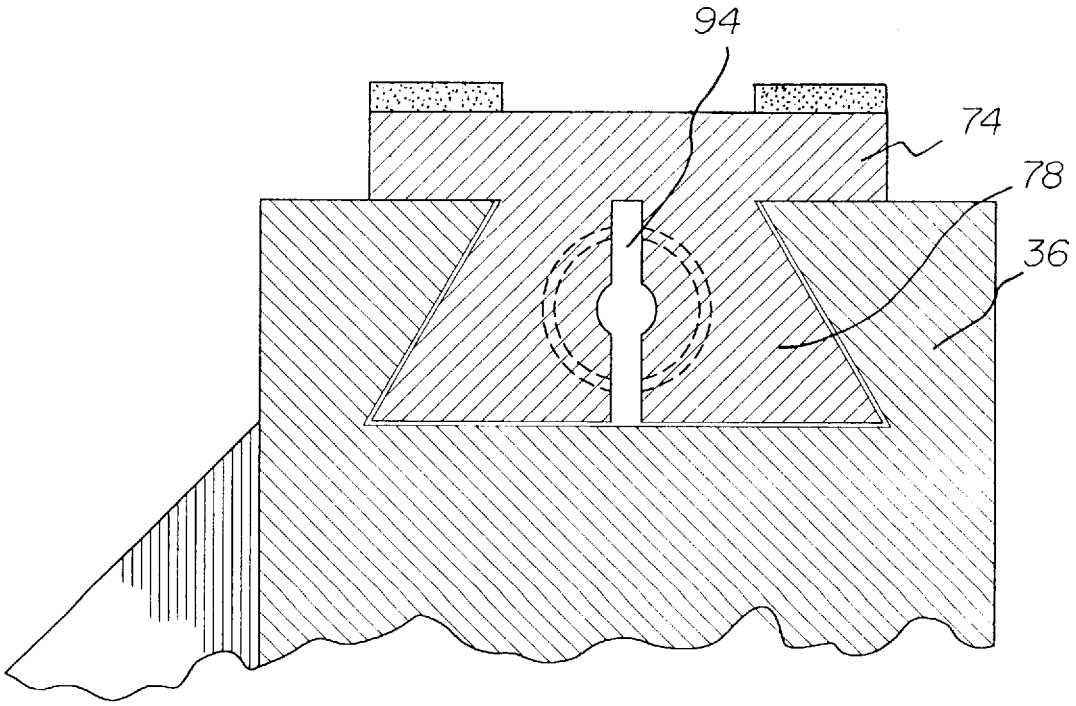
FIG. 8 is a cross sectional view taken along line 8—8 of FIG. 7.
Figure 9:
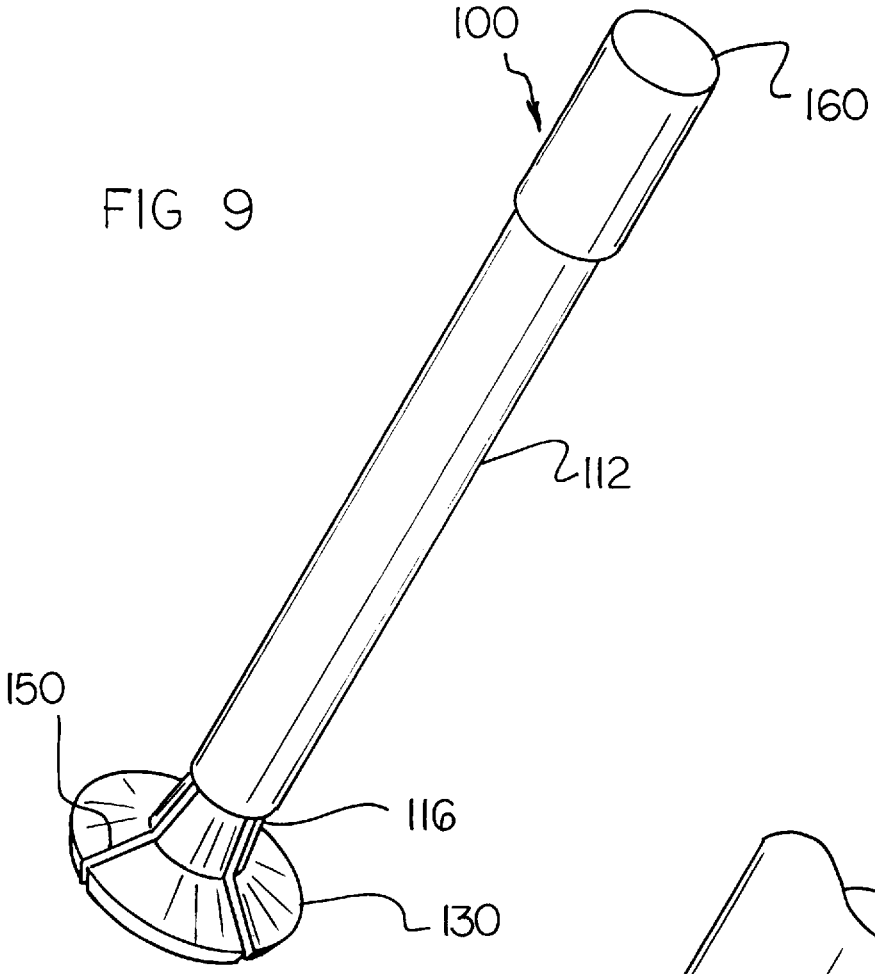
FIG. 9 is a perspective view of another alternate embodiment for refacing a valve seat.

An alternate embodiment of the invention is shown in FIGS. 7 and 8. According to such alternate embodiment, the securement component is a threaded pin 84. Such threaded pin has a tapering component 86 on its axially interior end 88. Such pin is adjustably received in a threaded aperture in a grind pad. The threaded aperture has a cone-shaped recess 90 at its axially interior end 92 at a different angle than that of the cone-shaped projection at the interior end of the threaded male member. In this manner, when the threaded member is threadedly inserted into the threaded aperture, the axially interior end thereof will cause an expansion of the dove-tail portion of the grind pad to lock in position. A vertical slot 94 in the grind pad allows this locking relationship to occur.

Yet another alternate embodiment of the present invention is shown in FIGS. 9–14. In such embodiment, a tool 100 is provided to facilitate the lapping of a valve associated with the valve seat. Such tool is preferably constructed from plastic. As shown in FIG. 12, the tool is equipped with an intermediate portion 112 having a cylindrical configuration with a top end 114, a bottom end 116 and an axial bore 118 formed therebetween. The bottom end has a cut out formed therein with a top extent 120 and a bottom extent 122. With reference still to FIG. 12, it can be seen that the top extent has a rectangular configuration and the bottom extent has a frusto-conical configuration. It should be noted that the top end of the intermediate portion has a cylindrical cut out 124 formed therein. While not illustrated it is preferred that an outer surface of the intermediate portion be knurled, for reasons that will become apparent later.

Figure 10:
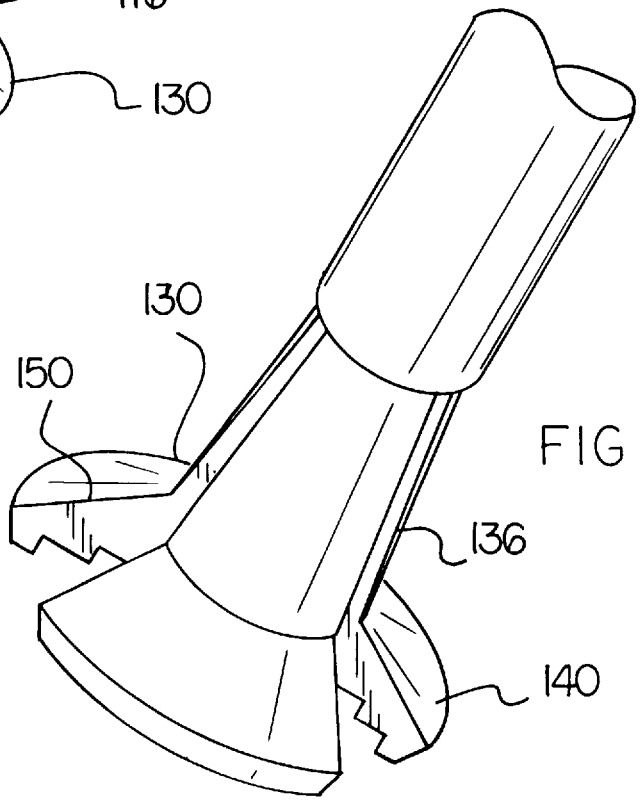
FIG. 10 is a close-up view of a lower extent of the alternate embodiment of the present invention.
Figure 13:
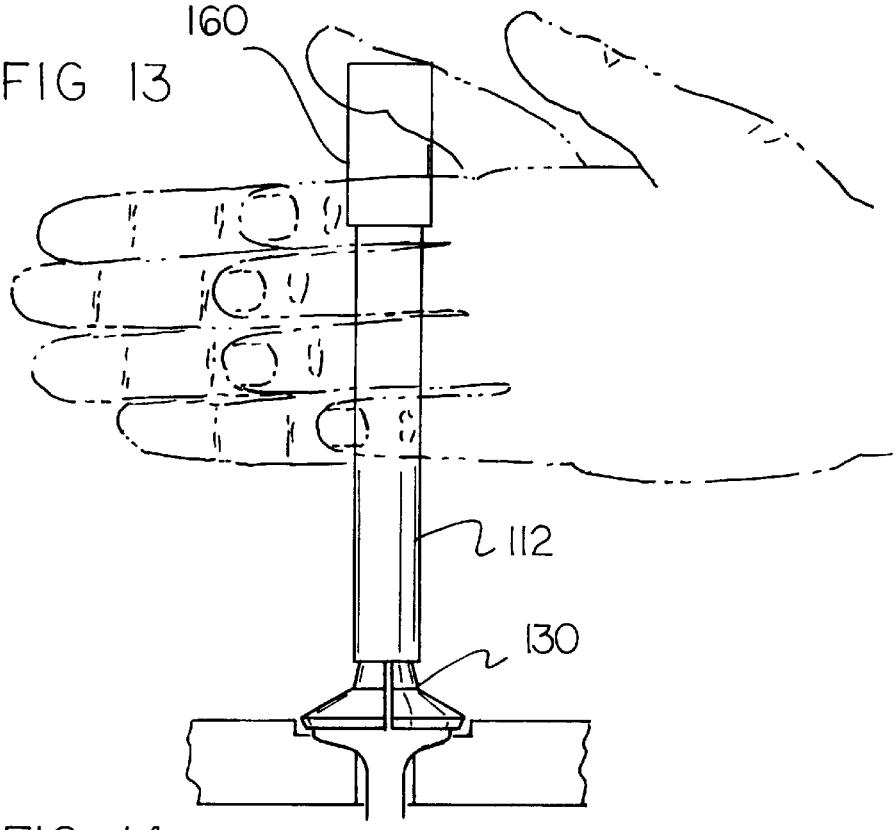
FIG. 13 is a side elevational view of the alternate embodiment of the present invention in use.
Figure 14:
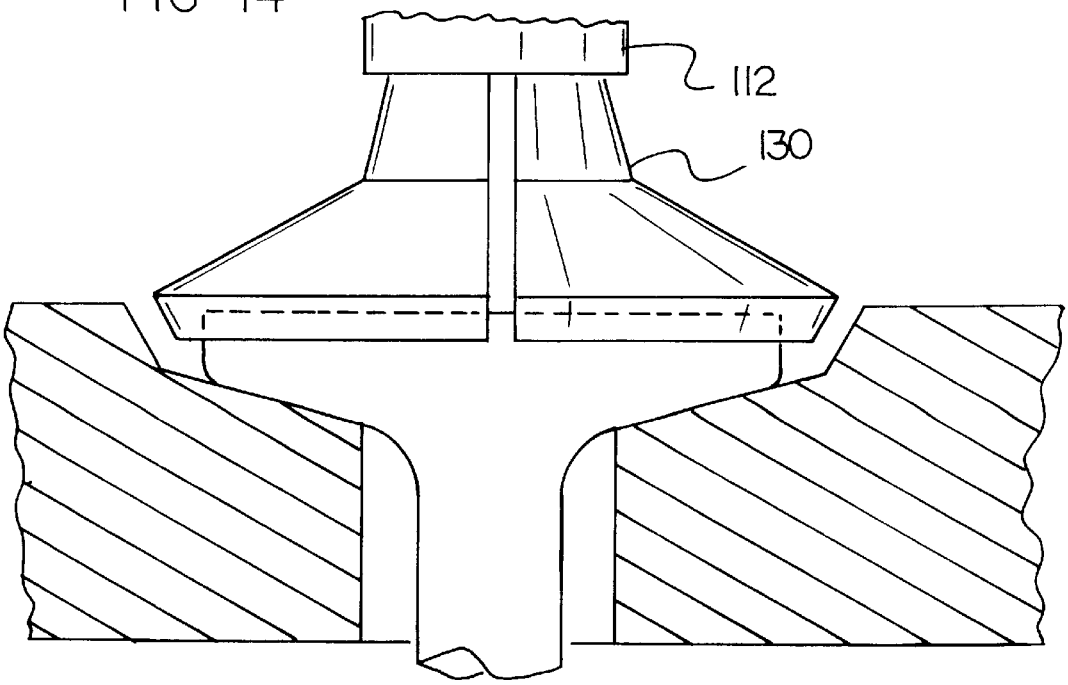
FIG. 14 is an enlarged cross-sectional view of the alternate embodiment of the present invention in use.

Further provided as a component of the tool of the present embodiment is a bottom portion 130, or collet, with a bore axially formed therein. The bore has a top part which is lined within threaded grooves 132, as can be seen in FIG. 12. The bottom portion further has an upper extent 134 with a rectangular configuration and an intermediate extent 136 with a frusto-conical configuration integrally coupled to the upper extent. Integrally coupled in axial alignment with a base of the intermediate extent is a lower extent 140 with a disk-shaped configuration. The lower extent further has a bottom face 142 with a first disk-shaped inset portion 144 with a first diameter and a second disk-shaped inset portion 146 with a second diameter greater than the first diameter. The first and second inset portion are coaxially aligned. Further, the first and second inset portion have a combined depth which is at least the height of the top portion of the valve. The lower extent further has a circular periphery 148 which is beveled inwardly and downwardly. This is imperative to afford adequate clearance between the bottom face of the gripping tool and an upper edge of the valve seat, as will become apparent later. Note FIG. 14. As best shown in FIGS. 10–12, the bottom portion is divided into a plurality of sub-sections by vertical slits 150. Such slits are ideally spaced 120 degrees apart. By this structure, upon the insertion of the bottom portion within the bottom end of the intermediate portion, rotation of the bottom portion with respect to the intermediate portion is precluded. The engagement of the rectangular upper extent of the bottom portion and the top extent of the cut out of the intermediate portion affords such feature. Further, the diameter of the first and second inset portions is reduced upon the aforementioned insertion of the bottom portion within the bottom end of the intermediate portion due to the engagement of the frusto-conical surfaces.

Also included is a top portion 160 with a cylindrical configuration. A bottom end of the top portion has a lip 162 integrally coupled thereto and depended downwardly therefrom. Such lip defines a sleeve which is slidably engaged with an outer surface of the top end of the intermediate portion. As shown in FIG. 12, the bottom end of the top portion has a cylindrical cut out 164 formed therein in axial alignment with the sleeve.

The present embodiment further includes an actuation rod 166. The actuation rod has a top end 168 coupled to the bottom end of the top portion in axial alignment with the cylindrical cut out thereof. Such coupling may be managed using various methods including the one shown in FIG. 12. The actuation rod further has a bottom end 170 with threaded grooves formed therein for threadedly coupling with the threaded grooves of the upper extent of the bottom portion. It should be noted that bottom portions of various sizes may thus be employed. When the tool is assembled, the rod is slidably situated within the bore of the intermediate portion and the top portion and bottom portion move coincidentally with respect to the intermediate portion. As such, the bottom portion has an extended orientation with the first and second inset portions having a larger diameter upon the sliding of the sleeve of the top portion downwardly. Further, the bottom portion also has a retracted portion with the first and second inset portions having a small diameter upon the sliding of the sleeve of the top portion upwardly. It is imperative that the length of the upper extent of the bottom portion be sufficient to ensure that the threaded engagement with the rod is maintained even when the bottom portion is in the extended orientation thereof.

To urge the bottom portion to the retracted orientation thereof, an actuation coiled spring 180 is included. The spring is situated between the cylindrical cut out of the top end of the intermediate portion and the cylindrical cut out of the bottom end of the top portion.

In a final alternate embodiment 200 of the present invention shown in FIGS. 15 & 16, the lower extent has a circular periphery 202 which is vertical instead of being beveled, as in the previous alternate embodiment. This allows an arcuate thin rectangular strip 204 to be situated within a slot 206 formed very close to the periphery of each associated sub-section. As such, each sub-section has an associated strip which extends downwardly for engaging the valve and requiring minimal space. In the present embodiment, the strip ideally comprises a 25 GA (0.020 thick) piece of spring steel. Such strip is placed in its proper position at the time of casting.

By providing the foregoing components, a unique method is afforded for lapping the valve associated with the valve seat. Such method further requires an abrasive fluid. Prior to refacing, or lapping, the user grips a top of a valve with the bottom portion of the tool. To accomplish such, the top portion is depressed to enlarge the diameter of the inset portions thereof. Upon the top of the valve being fitted within such inset portions, the top portion may be released whereat the spring maintains the bottom portion secured with the valve. Next, the abrasive fluid is applied to the face of the valve to be lapped or ground. The next step is to insert the valve within an associated valve seat. Finally, the tool is engaged on the opposite sides of the intermediate portion with the hands of the user to effect rotation of the valve within the valve seat. For best results, the hands are kept in parallel vertical planes while reciprocating back and forth.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A valve gripping tool for refacing an associated valve seat comprising, in combination:

an intermediate portion having a cylindrical configuration with a top end, a bottom end and an axial bore in communication with the top end and the bottom end, the bottom end having a cut out formed therein with a top extent with a rectangular configuration and a bottom extent with a frusto-conical configuration, the top end having a cylindrical cut out formed therein;

a bottom portion with a bore axially formed therein with the bore having a top part which is lined within threaded grooves, the bottom portion having an upper extent with a rectangular configuration, an intermediate extent with a frusto-conical configuration integrally coupled to the upper extent, and a lower extent with a disk-shaped configuration integrally coupled in axial alignment with a base of the intermediate extent, the lower extent having a bottom face with a first disk-shaped inset portion with a first diameter and a second disk-shaped inset portion with a second diameter greater than the first diameter, the lower extent further having a circular periphery which is beveled inwardly and downwardly, wherein the bottom portion is divided into a plurality of sub-sections by vertical slits such that upon the insertion of the bottom portion within the bottom end of the intermediate portion, rotation of the bottom portion with respect to the intermediate portion is precluded and further the diameter of the first and second inset portions is reduced;

a top portion with a cylindrical configuration with a bottom end having a lip integrally coupled thereto and depending downwardly therefrom thus defining a sleeve which is slidably engaged with an outer surface of the top end of the intermediate portion, the bottom end of the top portion having a cylindrical cut out formed therein in axial alignment with the sleeve;

an actuation rod having a top end coupled to the bottom end of the top portion in axial alignment with the cylindrical cut out thereof and a bottom end with threaded grooves formed therein for threadedly coupling with the threaded grooves of the upper extent, whereby the rod is slidably situated within the bore of the intermediate portion and the top portion and bottom portion move coincidentally with respect to the intermediate portion, the bottom portion having an extended orientation with the first and second inset portions having a larger diameter upon the sliding of the sleeve of the top portion downwardly, the bottom portion also having a retracted portion with the first and second inset portions having a small diameter upon the sliding of the sleeve of the top portion upwardly; and an actuation coiled spring situated between the cylindrical cut out of the top end of the intermediate portion and the cylindrical cut out of the bottom end of the top portion for urging the bottom portion to the retracted orientation thereof.

2. A valve gripping tool for refacing an associated valve seat comprising:

an intermediate portion having a cylindrical configuration; and a bottom portion with a bottom face having at least one disk shaped inset portion with an adjustable diameter, the bottom portion having a first orientation with the inset portion having a larger diameter and a second orientation with the inset portion having a small diameter for gripping a top of a valve;

said bottom portion precluded from rotating with respect to the intermediate portion.

3. A valve gripping tool for refacing an associated valve seat as set forth in claim 2 wherein the bottom portion has a frusto-conical configuration divided into a plurality of subsections by a plurality of vertical slits and the intermediate portion has a bottom end with a frusto-conical cut out formed therein, whereby the first orientation of the bottom portion is an extended orientation with the inset portion having the larger diameter and the second orientation is a retracted portion with the inset portion having the small diameter.

4. A valve gripping tool for refacing an associated valve seat as set forth in claim 2 wherein the bottom portion has a periphery which is bevelled downwardly and inwardly.

5. A valve gripping tool for refacing an associated valve seat as set forth in claim 2 and further including a spring for maintaining the bottom portion in the second orientation thereof.

6. A valve gripping tool for refacing an associated valve seat as set forth in claim 2 and further including a top portion that is adapted to transfer the bottom portion from the second orientation to the first orientation upon the depression thereof.

7. A valve gripping tool for refacing an associated valve seat as set forth in claim 2 wherein the bottom portion has a periphery which is vertical, the bottom portion having an arcuate thin strip situated very close to the periphery of the bottom portion.

8. A method of refacing valve seat with a valve with a valve gripping tool comprising the steps of:

providing an intermediate portion having a cylindrical configuration; and providing a bottom portion with a bottom face having at least one disk shaped inset portion with an adjustable diameter, the bottom portion having a first orientation with the inset portion having a larger diameter and a second orientation with the inset portion having a small diameter for gripping a top of a valve, whereby said bottom portion is precluded from rotating with respect to the intermediate portion;

providing an abrasive fluid;

gripping a top of a valve with the bottom portion;

applying an abrasive fluid to the valve;

inserting the valve within an associated valve seat; and rotating the tool with a pair of hands by engaging opposite sides of the intermediate portion with the hands which are kept in parallel vertical planes while reciprocating back and forth.

* * * * *